US006712872B2

(12) United States Patent
Krüger et al.

(10) Patent No.: US 6,712,872 B2
(45) Date of Patent: Mar. 30, 2004

(54) POWDER METALLURGY PRODUCED VALVE BODY AND VALVE FITTED WITH SAID VALVE BODY

(75) Inventors: Gerd Krüger, Wetter (DE); Hans-Joachim Kaschuba, Salzgitter (DE); Franz-Josef Schleifstein, Schmallenberg (DE)

(73) Assignees: Bleistahl-Produktions GmbH (DE); Volkswagen Aktiengesellschaft (DE)

( * ) Notice: Subject to any disclaimer, the term of this patent is extended or adjusted under 35 U.S.C. 154(b) by 0 days.

(21) Appl. No.: 10/169,951

(22) PCT Filed: Jan. 4, 2001

(86) PCT No.: PCT/EP01/00036

§ 371 (c)(1),
(2), (4) Date: Nov. 12, 2002

(87) PCT Pub. No.: WO01/49979

PCT Pub. Date: Jul. 12, 2001

(65) Prior Publication Data

US 2003/0136475 A1 Jul. 24, 2003

(51) Int. Cl.[7] ..... B22F 3/00
(52) U.S. Cl. ..... 75/243; 75/246
(58) Field of Search ..... 75/243, 246

(56) References Cited

U.S. PATENT DOCUMENTS 3,806,325 A * 4/1974 Niimi et al. ..... 428/568
3,856,478 A * 12/1974 Iwata et al. ..... 428/472
3,977,838 A * 8/1976 Hashimoto et al. ..... 75/230
4,778,522 A * 10/1988 Maki et al. ..... 75/238
4,964,908 A 10/1990 Greetham
5,221,321 A * 6/1993 Lim ..... 75/246
5,462,573 A * 10/1995 Baker et al. ..... 75/231
5,656,787 A 8/1997 Thieu et al.

FOREIGN PATENT DOCUMENTS

FR 2 596 067 A 9/1987
JP 61 270518 A 11/1986
JP 62 124256 A 6/1987
JP 3275908 A 12/1991

OTHER PUBLICATIONS

Murase, Hiroyuki. "Wear resistant sintered camshafts." Retrieved from STN Database accession No. 107:11319 CA XP002171319 abstract, *Chemical Abstracts Service*.
Nitsuta, Minoru et al. "Graphite precipitated sintered steel for sliding parts." Retrieved from STN Database accession No. 107:181148 CA XP 002171321 abstract, *Chemical Abstracts Service*.

* cited by examiner

*Primary Examiner*—Ngoclan Mai
(74) *Attorney, Agent, or Firm*—Fulbright & Jaworski LLP

(57) ABSTRACT

The invention relates to a valve body produced by powder metallurgical methods that exhibits high thermal and wear resistance and has the following composition by weight:

Figure 1:
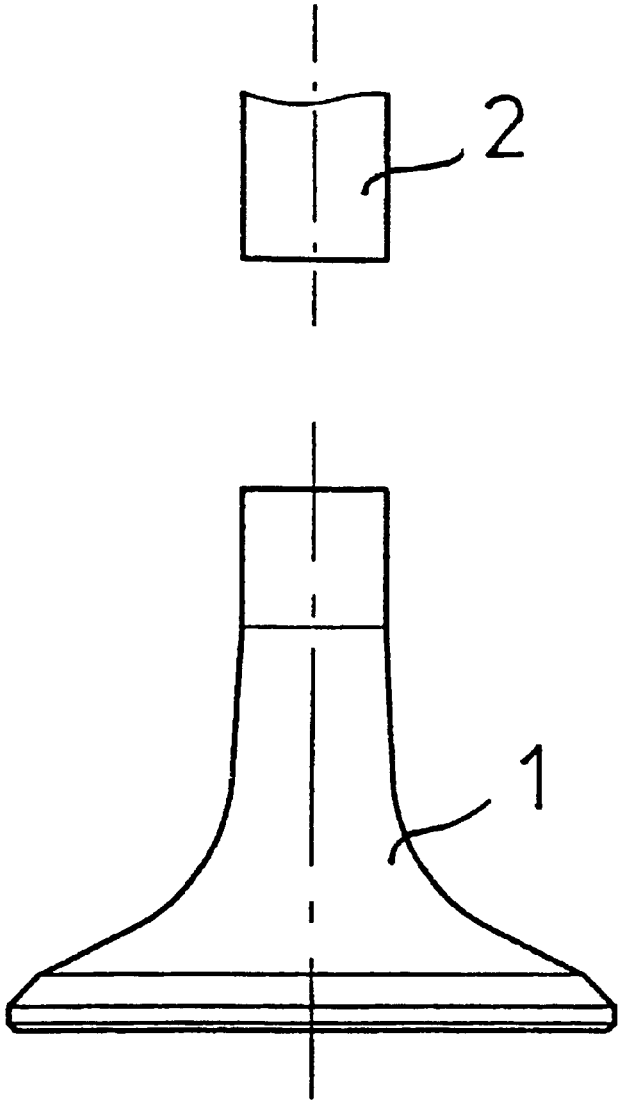

0.5% to 2.0% C; 5.0% to 16% Mo; 0.2% to 1.0% P; 0.1% to 1.4% Mn; 0% to 5% Cr; 0% to 5% S; 0% to 7% W; 0% to 3% V, <2% of other elements with the remainder being Fe.

It also relates to a valve fitted with such valve body.

8 Claims, 1 Drawing Sheet

POWDER METALLURGY PRODUCED VALVE BODY AND VALVE FITTED WITH SAID VALVE BODY

The invention relates to a valve body produced by powder metallurgical methods that exhibits high thermal and wear resistance and to a valve for combustion engines fitted with said valve body.

Inlet and outlet valves for combustion engines must satisfy high requirements with respect to thermal endurance and wear resistance. Especially for the high-compression engines of multi-valve and electronic control design it has been more and more difficult to find materials that on a long-term basis meet the needs linked with the high temperatures arising at the outlet. Valves manufacture has become more and more sophisticated and expensive and the material and machining costs involved in the process reflect this.

For the production of valve bodies or entire valves powder metallurgical methods have been proposed occasionally. Such powder-metallurgical processes have been used in the manufacture of valve seat inserts but have not yet gained widespread acceptance in the production of valve bodies or valves proper. Reasons for this were an insufficient durability of the materials and their inadequate performance in terms of thermal resistance.

To enhance the performance of conventionally manufactured valves inductive hardening or armoring methods have been employed to process particularly stressed areas—particularly for the valve seat. This measure aims at keeping wear within acceptable limits with consideration to be given to the fact that even with this technology valve temperatures of between 800° C. and 900° C. should not be exceeded. Nevertheless, it is increasingly difficult to meet this requirement with present-day engines.

Producing valves and valve bodies by conventional processes has become extremely complex, particularly with respect to seat armoring. Starting out with a rod segment the valve body is produced initially by heating, upsetting, calibrating and turning, to which then a rod segment is attached by friction welding. Additional working steps comprise straightening, turning, grinding, and build-up welding, grinding and heat treatment to produce the finished valve with seat armoring. Especially, the seat armoring step involving build-up welding may lead to faults associated with unacceptably high reject rates.

Solutions aimed at providing a suitable seat armoring in the form of powder metallurgically produced armorings were sought but could not reach a mass production status. Applying the seat armoring did not bring about a reduction of the failure rate. Such an armoring produced by powder metallurgical methods rather turned out to be susceptible to crack formation during subsequent processing steps.

With respect to the materials and additional processing steps required to produce armored or hardened seats it appears to be desirable to make valve bodies of a homogeneous material in as few steps as possible with the material having the necessary wear resistance, service life and heat dissipation characteristics and with the body being connected to a rod thus forming a valve.

Methods for the production of at least the wear lining of high-duty sintered parts in connection with the control of valves in an internal combustion engine are known from DE 41 04 909 A1. The sintered parts thus produced by powder metallurgical steps feature a high chromium and carbon content and are employed as cams for valve control purposes. Using such sintered parts for valve bodies has not been envisaged.

For the production of sophisticated shaped parts powder metallurgy frequently offers advantages over conventional techniques in that the material characteristics can be optimized and the number of processing steps reduced.

Therefore, it is the object of the invention to produce valve bodies for valves by powder metallurgical methods from a material suitable for the purpose, particularly with a view to reducing the manufacturing expenditure. This method shall render a seat armoring dispensable and the valve, respectively the valve body shall feature thermal conductivity properties sufficient for temperature control. The valve body shall be connected with a conventionally manufactured valve rod by butt-joining methods thus forming a functioning and durable valve.

This object is achieved by providing a powder metallurgically manufactured valve body having the following composition by weight:

0.5% to 2.0% C; 5.0% to 16% Mo; 0.2% to 1.0% P; 0.1% to 1.4% Mn; 0% to 5% Cr; 0% to 5% S; 0% to 7% W; 0% to 3% V; <2% other elements, the remainder being Fe.

The invention also relates to valves manufactured with such valve bodies.

The metal powder used according to the invention is characterized particularly by a rather high content of carbon, molybdenum, and phosphorus.

The carbon and phosphorus constituents bring about the formation of temperature resistant and wear reducing carbide and phosphide phases that lend to the material the service life span required. Chromium, vanadium and tungsten may be added to enrich or vary the property spectrum but, especially for the production of valves and valve parts, are not necessarily needed. An appreciable content of sulfur, especially when present in the form of $MoS_2$, may serve as an internal lubricant but as a rule is not required for valves and components.

Valve bodies produced by powder metallurgical methods according to the invention may be manufactured by conventional pressure sintering processes. These include hot isostatic pressing although the process is not necessarily required. Normally, a compaction of 7.5 g/cm$^3$ is sufficient even though a higher density, in particular appr. 7.7 g/cm$^3$ or higher, offers significant benefits. By increasing the density and thus causing the pore volume to be reduced the heat conductivity characteristics and temperature behavior are improved. Moreover, the valve service life is improved.

The valve bodies according to the invention can be produced by the respective element powders. However, it will usually be expedient to use completely alloyed constituents for the manufacturing process, for example, a completely alloyed steel component, a phosphorus-molybdenum steel, possibly $MoS_2$, and, if necessary, graphite as additive, each in powder form. An especially preferred embodiment is the use of metal powders of irregular particle form produced by atomizing processes that due to their interlocking capability may lend a certain inherent cohesion to the pressed part produced from these substances. To improve the workability, reduce wear in presses and enhance the cohesion capability of the substances auxiliary agents may be used as additives, for example wax, up to an amount of 1% by weight based on the alloying powder.

Preferably, dendritic or spattering powders having a mean diameter of less than 150 $\mu$m are put to use, preferably of a size of less than 50 $\mu$m. Most expediently, carbon is to be admixed in the form of graphite having an average grain size of 10 $\mu$m or less unless contained in the completely alloyed powder in sufficient quantity. The PMoFe steel powder as can be used for the purpose outlined here has been described in WO-A-91/18123.

An especially preferred powder composition for the manufacture of valve bodies consists of 0.5 to 2.0% carbon, 5.0 to 14% molybdenum, 0.2 to 1.0% phosphorus, 0.1 to 1.2% manganese, with a maximum of 0.50% of chromium and maximum of 0.40% of sulfur. Other elements in this case are present in the amount of less than 2% with the remainder being iron. The composition indicated reflects percentages by weight.

For the valve bodies according to the invention it is recommendable to use the liquid-phase sintering process. The finished valve body should have a density of at least 7.7 g/cm$^3$.

As compared with the conventional manufacturing process for complete valves described above the inventive powder metallurgically produced valve bodies and the valves manufactured with such bodies offer a significantly reduced number of processing steps. In the production of a valve according to the invention using a separately manufactured valve body and a rod segment the following steps are involved:

At first pressing and tempering of the valve body followed by the provision of the rod segment, joining together valve body and rod segment, for example by friction welding, straightening, turning, grinding and heat treating the completed valve. As a result of the significantly decreased number of production steps the manufacturing accuracy is improved and the failure probability brought down. Moreover, the reduced number of production steps makes it possible to react more flexibly to changing system requirements.

The valves and valve bodies according to the invention feature high wear resistance even at elevated temperatures and high loads in the valve gear mechanism, particularly for outlet valves.

With respect to the valves proper the valve body consists of the above mentioned materials. The shaft is produced by conventional methods, i.e. without powder metallurgical processes, employing a conventional material. Valve body and valve rod are connected by means of a butt-joining method. For such a butt-joint connection a friction welding process is preferred, however, other joining processes may be employed as well.

As far as the invention relates to valve bodies these offer benefits over conventionally produced valve bodies in that they consist of a homogeneous material and thus do not need to be modified locally to suit the special configuration of a piston outlet in an internal combustion engine. Apart from advantages associated with the production processes this reduces susceptibility to failures and defects in the product both during production and operation.

The valve bodies according to the invention are produced from the pre-mixed or completely alloyed powder as follows. At first, the green compact is produced from the powder with the aid of a customary wax serving as lubricant and by applying known compacting pressures to achieve compacts of adequate density. For this purpose the compacting pressure most expediently ranges between 500 and 900 MPa. After pressing the product is initially dewaxed under a protective hydrogen-nitrogen gas blanket at temperatures between 500 and 750° C. and subsequently sintered in a furnace at a temperature of more than 900° C., preferably more than 1000° C., and up to 1150° C. Pressures and temperatures in this case primarily depend on the desired density of the compact and composition of the metal powder. Having cooled down the compacts are subjected to a tempering treatment and further processing steps as required.

As mentioned above, valve bodies and valve shafts according to the invention used for the manufacture of valves for internal combustion engines are produced in separate processing steps and then joined. Said valve body is produced by powder metallurgical methods, the shaft end by conventional processes. Body and shaft in this particular configuration can be joined by friction welding. Following the step of joining the components the valve is subjected to further processing steps.

FIG. 1 depicts a valve body 1 that has been made by powder metallurgical methods and is intended for a butt-joining connection with a shaft 2.

EXAMPLE:

For a valve body according to the invention metal powder of the following chemical composition by weight has been used: 0.9% carbon, 8.2% molybdenum, 4.8% tungsten, 1.4% vanadium, 0.42% phosphorus, 3.2% chromium and 1.2% sulfur.

Other elements were present in the mixture in the amount of about 1.9% with the remainder being iron.

A sintered compact of sintered molybdenum-phosphorus steel was obtained that had a density of 6.9 g/cm$^3$. When subjected to high surface loads the compact showed good wear resistance and in the structure various finely dispersed carbides in a tempered martensitic matrix with an embedded solid lubricant.

What is claimed is:

1. A valve body produced by a powder metallurgical method from a metal powder that is at least to some extent, in the form of a completely alloyed PMoFe powder, and having a high resistance to temperatures and wear, comprising the following composition by weight: 0.5% to 2.0% C; 5.0% to 16% Mo; 0.2% to 1.0% P; 0.1% to 1.4% Mn; 0% to 5% Cr; 0% to 5% S; 0% to 7% W; 0% to 3% V, <2% of other elements with the remainder being Fe.

2. The valve body of claim 1, wherein said body has a density of at least 7.5 g/cm$^3$.

3. The valve body of claim 1, wherein the powder is used in the process in atomized condition.

4. The valve body of claim 1, wherein the following composition by weight is used: 0.5% to 2.0% C; 5.0% to 14% Mo; 0.2% to 1.0% P; 0.1% to 1.2% Mn max. 0.5% Cr, max. 0.4% S, <2% other elements, remainder Fe.

5. The valve body of claim 1 and having a density of at least 7.7 g/cm$^3$.

6. The valve body of claim 1, wherein said body is compacted by means of the liquid-phase sintering process.

7. A valve, comprising a valve body of claim 1 and a shaft made by conventional methods and connected by a butt joining process.

8. The valve according to claim 7, wherein the valve body and valve shaft are connected by friction welding.

* * * * *